US006655686B1

(12) United States Patent
Morgan

(10) Patent No.: US 6,655,686 B1
(45) Date of Patent: Dec. 2, 2003

(54) RECYCLING BOARD GAME HAVING SCENTED GAME PIECES AND METHOD OF PLAY

(75) Inventor: Peggy Annette Morgan, Manuels (CA)

(73) Assignee: Hzosea Holdings, Inc. (CA)

( * ) Notice: Subject to any disclaimer, the term of this patent is extended or adjusted under 35 U.S.C. 154(b) by 0 days.

(21) Appl. No.: 10/234,667

(22) Filed: Sep. 3, 2002

(51) Int. Cl.[7] ..... A63F 3/00

(52) U.S. Cl. ..... 273/248; 273/292; 273/429; 273/440

(58) Field of Search ..... 273/248, 249, 273/292, 429, 430, 440

(56) References Cited

U.S. PATENT DOCUMENTS 3,627,325 A * 12/1971 Breslow ..... 273/295
5,277,429 A * 1/1994 Smith, III ..... 463/10
5,918,882 A * 7/1999 Truong ..... 273/249

FOREIGN PATENT DOCUMENTS

FR 2616675 A * 12/1988 ..... A63F/3/00
GB 2239609 A * 7/1991 ..... A63F/9/00

* cited by examiner

*Primary Examiner*—Benjamin H. Layno
*Assistant Examiner*—Vishu Mendiratta
(74) *Attorney, Agent, or Firm*—Schmeiser, Olsen & Watts

(57) ABSTRACT

The present invention comprises a board game promoting recycling, and method of play thereof, that includes a game board including a playing path having a series of game playing spaces therealong, the path beginning with a start space and terminating with an end space, with each of the playing spaces requiring a player to either accept a reward, incur a penalty, or correctly guess a scent contained within a scent containing game piece. Rewards given to players may be simulated game currency or acquiring game pieces, each simulating a recyclable item and having a specified monetary value. The goal for a player in winning the game is to successfully circumnavigate the playing path of the game board through to the end space, and accumulate the highest monetary total from among the other players.

21 Claims, 3 Drawing Sheets

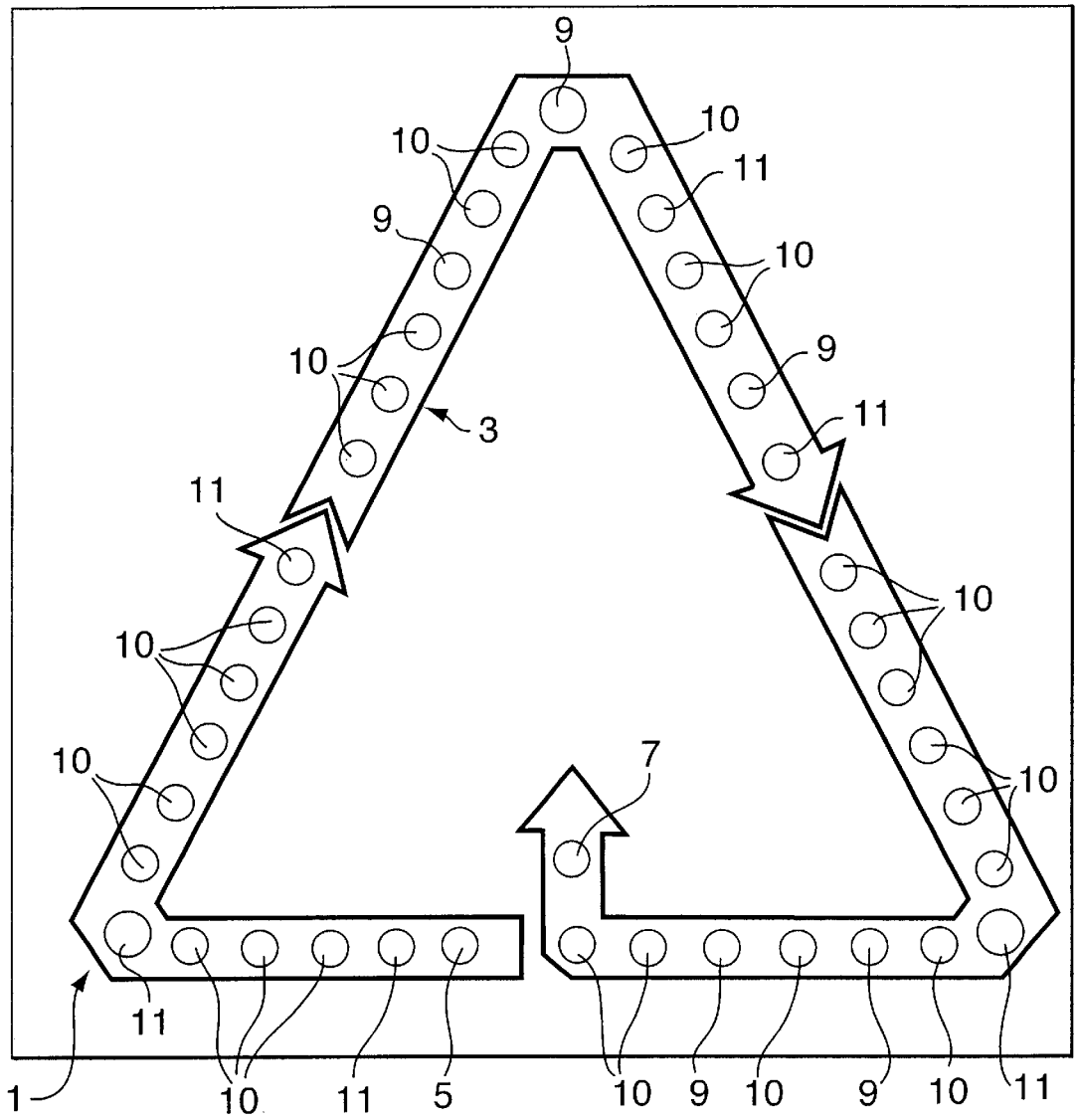
FIG. 1
FIG. 2
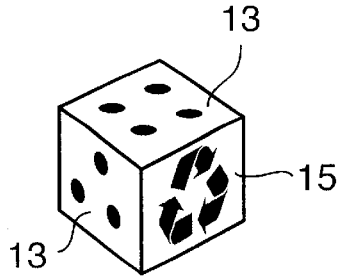

RECYCLING BOARD GAME HAVING SCENTED GAME PIECES AND METHOD OF PLAY

The present invention relates generally to a recreational game which allows game players to incorporate an olfactory response into game play, through the selection and identification of scented game pieces, and more particularly to a board game for teaching, promoting and reinforcing the benefits and importance of recycling in children and others.

As is common knowledge, games can be used to instruct as well as to entertain. It would be a benefit, therefore, to have a board game that could heighten awareness of environmental issues, and promote the benefits of recycling, especially to young children, while at the same time providing entertainment to the players. It would be a further benefit to have such a board game which incorporates an olfactory response into game play, so as to create a unique gaming experience.

DESCRIPTION OF THE PRIOR ART

Numerous board games have been provided which have been adapted to entertain the game players by challenging them, so that they may utilize skill in playing the game, while at the same time providing an element of chance which adds a bit of adventure and luck to the game. Fewer still, are board games which combine the above-noted elements, while at the same time providing a board game in which the reactions and responses of any of the human senses can be incorporated into game play. U.S. Pat. No. 5,918,882, for example, proposes a game for testing the acuity of the senses. However, this board game merely provides questions relating to the senses of touch, taste, hearing and smell for each of the game players to be answered, and there is no recognition of, or suggested incorporation of, olfactory responses of the players which can be incorporated into game play. Accordingly, it would be beneficial and entertaining to have a board game which incorporates the elements of skill and chance, while providing the opportunity to incorporate olfactory responses of the players into game play.

SUMMARY OF THE INVENTION

Thus, a primary object of the present invention is to provide a unique board game in which the players utilize and acquire symbolic recyclable items such as, for example, tin cans, aluminum and cardboard, when playing the game, so as to promote and heighten the awareness of the importance of recycling.

Another object is to provide a board game in which the players may incorporate olfactory responses into game play, so as to provide a balance between skill and chance when playing the game, in a manner which can entertain and challenge all of the players.

One aspect of the present invention provides a board game for a plurality of players, comprising a game board having a playing path; said playing path being divided into a plurality of playing spaces therealong, the playing path beginning with a start space and terminating with an end space; each of said playing spaces requiring a player to accept a reward, a penalty, or perform an action; a plurality of individual player position markers; a quantity of game money or other reward token for distribution of a part thereof to the players during play of said board game; random number generation means for determining successive movements of each of said markers to a particular space in the playing path on said game board; a plurality of reward cards, whereby when a side of the random number generation means lands head side up, the player will select a reward card and follow instruction thereon; a plurality of penalty cards, whereby when another side of the random number generation means lands head side up, the player will select a penalty card and follow instruction thereon; a plurality of scented game pieces, whereby when one of said player position markers lands on a particular action space in the playing path, the player is required to attempt to identify a scent within one of the scented game pieces, whereby, if the player is correct in identifying the scent, a quantity of game money or reward tokens is distributed to the player; and a plurality of miniature recyclable game pieces, each of the recyclable game pieces identifying a recyclable item and having a corresponding game money or token value, whereby when a player position marker lands on an action space in the playing path, the player is able to obtain the recyclable game piece indicated on the said action space.

Another particular aspect of the present invention provides a method of playing a board game comprising the steps of providing a game board having a playing path divided into a plurality of playing spaces therealong, the playing path beginning with a start space and terminating with an end space; each of said playing spaces requiring a player to accept a reward, a penalty, or perform an action, said game board further including a first location for holding reward cards and a second location for holding penalty cards; providing a plurality of individual player position markers; providing a specialized die for determining successive movements of each of said plurality of individual player position markers to a particular space in the playing path on said game board; providing a quantity of game money or other reward token for distribution of a part thereof to the players during play of said board game; providing a plurality of reward cards, whereby when a side of the specialized die lands head side up, the player will select a reward card and follow instruction thereon; providing a plurality of penalty cards, whereby when another side of the specialized die lands head side up, the player will select a penalty card and follow instruction thereon; providing a plurality of scented game pieces, whereby when one of said player position markers lands on a particular action space in the playing path on the game board, the player is required to attempt to identify a scent within one of the scented game pieces, whereby, if the player is correct in identifying the scent, a quantity of game money or reward tokens are distributed to the player; providing a plurality of miniature recyclable game pieces, each of the recyclable game pieces identifying a recyclable item and having a corresponding game money or token value, whereby when a player position marker lands on an action space in the playing path, the player is able to obtain the recyclable game piece indicated on the said action space; positioning the plurality of individual player position markers onto the start space for each player to play; each player sequentially tossing the specialized die onto a surface of the game board; each player moving a respective individual player position marker along the playing path a number of playing spaces away from the start space that corresponds to the number of the specialized die that lands head side up; each player circumnavigating the game board, by alternating movement of respective individual player position markers along the playing path, through to said end space; awarding bonus game money or reward tokens to the player moving a respective individual player position marker into said end space first, whereby the game ends; and declaring as winner the player with the highest accumulated total of game money value or reward tokens.

The recycling board game of the present invention preferably includes a game board including a triangular shaped playing path, so as to represent a recycling symbol, comprising a clockwise oriented sequence of playing spaces, the sequence beginning with a start space and terminating in an end space. Preferably, the playing path consists of 40 consecutive playing spaces. Alternatively, the triangular playing path can comprise a counterclockwise oriented sequence of playing spaces, with as many playing spaces as is required. In addition, the playing path can be any other designed configuration, including, for example, square, polygonal, circular, oval or serpentine.

The playing spaces include penalty indicia spaces, reward indicia spaces, and "Nose" indicia spaces, which require a player landing thereon to select from one of 20 scented game pieces, in the form of a barrel, to try to identify the scent therein.

There is also provided a number of individual position markers, one for each player; a quantity of game money for distribution to the players during the game; the aforementioned scented game pieces, a specialized die for determining successive movement of the position markers of the players during the game; a number of miniature recyclable game pieces, each of which represents a type of recyclable item having a corresponding game money or token value; and a number of penalty and reward cards indicating reward or penalty information thereon. There is also provided at least one container from which the recyclable game pieces are stored, and distributed therefrom, to the players, and each player is further provided with a receptacle within which they may store the recyclable game pieces accumulated during game play. Finally, a "recycling depot" is also provided, wherein the scented game pieces are stored during game play.

The recycling game of the present invention is played by each player alternatingly tossing the specialized die onto a surface. The player with the highest toss moves first, all other players continuing in a clockwise sequence, wherein each player moves an individual player position marker along the sequence of playing spaces on the game board according to the result of the toss. The player with the highest toss is also designated as the "Depot Manager", who is to distribute and collect game money to and from the players during the game. Game money and recyclable items, each of which has a corresponding game money value, are accumulated as each player travels from the start space to the end space. Preferably, the game money is provided in denominations of $5, $10, $20, $50, and $100, though it is also possible that the game can be played using game tokens or the like, in lieu of using game money.

During play, landing on a penalty indicia space results in the designated penalty being levied, such as losing a turn, moving back one or more spaces, being forced to return to the start area, or being forced to return all recyclable items accumulated during game play. Conversely, landing on a reward indicia space results in acquiring the designated reward, such as collecting game money, a variety of recyclable items, being able to switch spaces with another player, or advancing a number of spaces. Landing on a "Nose" indicia space results in the player receiving the opportunity to try to identify a scent contained within one of the scented game pieces, wherein if the player is successful, a cash reward is provided.

Players may also accumulate, or lose, game money value by drawing reward cards or penalty cards. The specialized six-sided die to be used during game play, has 1,2,3 or 4 dots for indicating player movement along the playing path during game play, with the two remaining sides of the die containing both a green and blue recycling symbol; the blue side, should it come up during a player toss, indicates that a penalty card is to be awarded to the player, and the green symbol indicates that a reward card is to be presented to the player. The rewards and penalties noted upon each of the reward and penalty cards correspond in a similar manner to the rewards and penalties which are indicated upon the playing surfaces of the surface of the game board.

The first player to enter the end space is awarded $100 in game money, and the game ends, wherein each of the players then totals up the amount of game money in their possession, both in terms of actual game money, and in terms of the game money value of the recyclable items they each possess at game's end. The player with the most accumulated game money value is declared the winner. In the event of a tie, the player who has reached the end space first is declared the winner. If other players are tied (excluding the player who finished), then the winner is determined by a roll of the die, or, in another embodiment of the present invention, move to a "Smell-Off" round. In the "Smell-Off" round, each player tied selects a scented game piece (barrel). The first player who incorrectly tries to identify the scent contained within the scented game piece loses, and the other player is declared the winner. This may involve several rounds of play, and may even continue until all scented game pieces (barrels) have been emptied from the Recycling Depot. In this event, the players must use a toss of the specialized die to declare a winner, with the highest toss determining the outcome.

In a further embodiment of the present invention, a price card is also provided with the board game of the present invention, whereby the corresponding game money value of each of the recyclable items used during the game can be noted thereon for easy reference.

BRIEF DESCRIPTION OF THE DRAWINGS

Embodiments of the present invention will be further described with reference to the accompanying drawings, in which:

FIG. 1 is a diagrammatic top plan view of an embodiment of the game board of the present invention used during game play, illustrating the playing path and start and finish spaces;

FIG. 2 is a perspective view of a specialized die for use in accordance with the present invention;

DETAILED DESCRIPTION OF THE DRAWINGS

Figure 3:
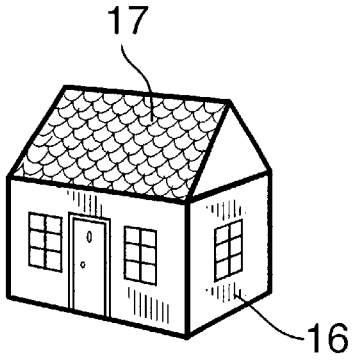
FIG. 3 is a perspective view of a "recycling depot" for use in storing the scented game pieces, in accordance with one embodiment of the present invention.

FIG. 1 shows an exemplary embodiment of the game board of the present invention, generally designated (1). The game board (1) has a top surface having a playing path of clockwise oriented playing spaces, generally designated (3), that begin with a start space (5) and finish with an end space (7). Playing spaces (3) include penalty indicia spaces (9), reward indicia spaces (10), and "Nose" indicia spaces (11), which indicate that a player must try to correctly identify a scent from a scented game piece. During play, landing on a penalty indicia space (9) results in the player accruing the designated penalty, such as switching spaces with another player, losing a turn, moving back one or more spaces, being forced to return to the start area, or being forced to return all recyclable items accumulated during game play. Landing on a reward indicia space (10) results in the player acquiring the designated reward, such as collecting game money, a variety of recyclable items, being able to switch spaces with another player, or advancing a number of spaces. Landing on a "Nose" indicia space (11) results in the player receiving the opportunity to try to identify a scent contained within one of the scented game pieces (18) of the present invention noted in FIG. 4, wherein if the player is successful, a cash reward is provided.

With reference to FIG. 2, the specialized die to be used during game play is essentially a six-sided die having 1,2,3 or 4 dots (13) on four sides of the die for indicating player movement along the playing path during game play, with the two remaining sides of the die containing both a green and blue recycling symbol (15); the blue side, should it come up during a player toss, indicating that a penalty card is to be awarded to the player, and the green symbol indicating that a reward card is to be presented to the player.

Figure 4:
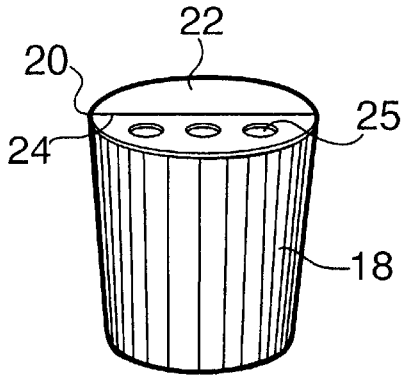
FIG. 4 is a perspective view of one of the scented game pieces, for use in accordance with the present invention.

With reference to FIG. 3, in this embodiment of the board game of the present invention, there is provided a "recycling depot" (16) which can be used for storing the scented game pieces (18) of the present invention, noted in FIG. 4. The recycling depot (16) features a removable roof (17), whereby the players can access the scented game pieces (18) contained therein. It should be noted, however, that the board game can be played by using any other common receptacle for storing the scented game pieces (18), or, in the alternative, it is also possible that the scented game pieces (18) can be arranged and stored off the board surface during game play, wherein a receptacle is not needed to store them at all.

With reference to FIG. 4, the board game of the present invention includes a number of scented game pieces, generally indicated as (18). At a top portion, each of the scented game pieces (18) is divided into two, pivotally liftable portions (designated as 22 and 24) along a center line (20). The first liftable portion (22), can be lifted so as to reveal to a player the correct scent identified within the scented game piece (18), the indication as to the actual scent being provided, for example, on a slip of paper which can be inserted into the scented game piece (18), and then concealed by closing the first liftable portion (22). The second liftable portion (24) possesses a plurality of openings (25), whereby the odour of the scented game piece (18) may emanate therefrom, so that a player may attempt to discern it. In the event that this is not sufficient, the second liftable portion (24) may be flipped open, so that greater olfactory access may be gained to the scent contained within the scented game piece (18).

Figure 5:
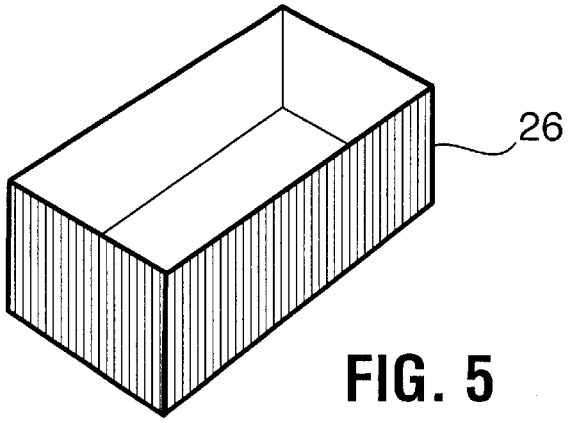
FIG. 5 is a perspective view of a "dumpster" for use in storing and distributing therefrom the recyclable items to the players, in accordance with one embodiment of the present invention.
Figure 6:
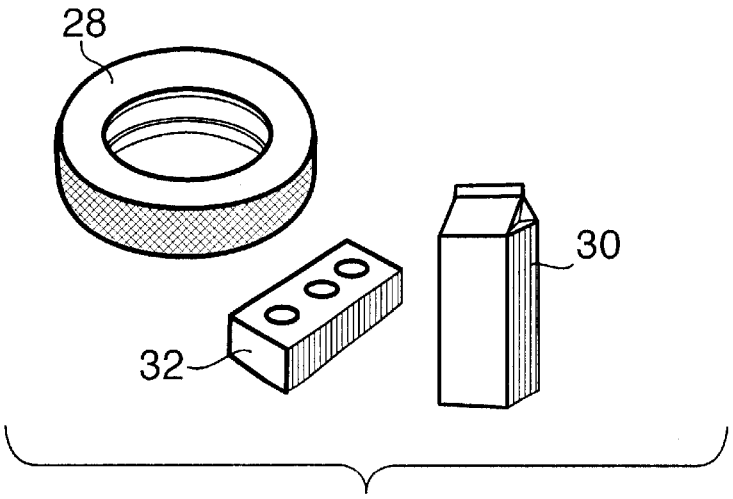
FIG. 6 is a diagrammatic illustration of several of the recycling items used during game play, in accordance with the present invention.

With reference to FIG. 5, in this embodiment of the board game of the present invention, there is provided at least one "dumpster" container (26) which can be used for storing, and distributing therefrom, the recyclable items (generally designated as 28,30,32) of the present invention, noted in FIG. 6.

With reference to FIG. 6, the board game of the present invention includes a number of miniature recyclable game pieces, each of which is meant to represent a different recyclable item. In FIG. 6, there is illustrated a rubber tire (28), a milk carton (30), and a brick (32). There may be an untold number of different recyclable pieces which can be used to represent various recyclable items used during game play, such as food waste, cardboard, plastic bottles, batteries, aluminum or tin cans, glass, paper, timber, and so forth.

Figure 7:
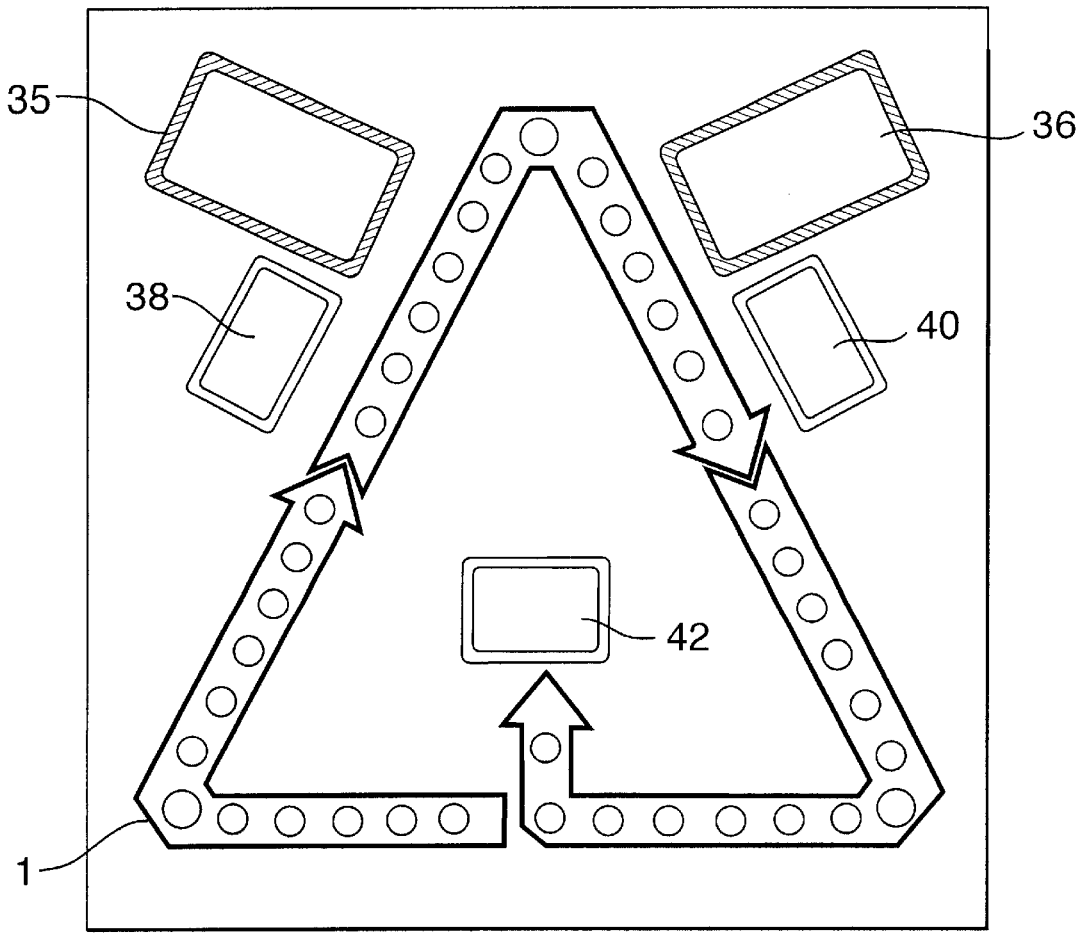
FIG. 7 is a diagrammatic top plan view of the game board of another embodiment of the present invention used during game play, illustrating the playing path and start and finish spaces, as well as outlined areas on the game board for placing reward and penalty cards, and the "dumpster" illustrated in FIG. 5.

With reference to FIG. 7, the top surface of the game board (1) of the present invention, in a further embodiment thereof, can also be provided with a reward card positioning space (40), a penalty card positioning space (38), a recycling depot positioning space (42), and two designated "dumpster" positioning spaces (designated as 35 and 36) for positioning, respectively, the decks of reward and penalty cards, recycling depot and "dumpster" containers during game play.

Figure 8:
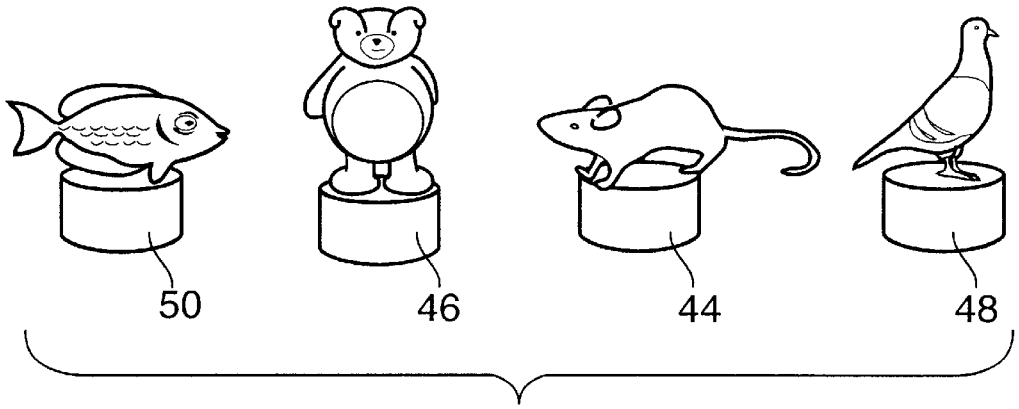
FIG. 8 is a diagram of individual position markers to be used during game play, in accordance with one embodiment of the present invention.

With reference to FIG. 8, an embodiment of the board game of the present invention includes a number of individual position markers, which are shaped to represent, for example, a Rat (44), a Bear (46), a Pigeon (48), and a Fish (50). Although in this embodiment a number of molded individual position markers are provided, any item such as coins or other markers can be used to indicate a player's position on the game board (1).

It can be seen from the preceding description that a board game has been provided that can promote and reinforce to the players the benefits of recycling, as well as provide entertainment to the players. The foregoing are exemplary embodiments of the present invention and a person skilled in the art would appreciate that modifications to these embodiments may be made without departing from the scope and spirit of the invention.

I claim:

1. A board game for a plurality of players, comprising:

a game board having a playing path; said playing path being divided into a plurality of playing spaces therealong, the playing path beginning with a start space and terminating with an end space; each of said playing spaces requiring a player to accept a reward, a penalty, or perform an action;

a plurality of individual player position markers;

a quantity of game money or other reward token for distribution of a part thereof to the players during play of said board game;

random number generation means for determining successive movements of each of said markers to a particular space in the playing path on said game board;

a plurality of reward cards, whereby when a side of the random number generation means lands head side up, the player will select a reward card and follow instruction thereon;

a plurality of penalty cards, whereby when another side of the random number generation means lands head side up, the player will select a penalty card and follow instruction thereon;

a plurality of scented game pieces, whereby when one of said player position markers lands on a particular action space in the playing path, the player is required to attempt to identify a scent within one of the scented game pieces, whereby, if the player is correct in identifying the scent, a quantity of game money or reward tokens is distributed to the player; and a plurality of miniature recyclable game pieces, each of the recyclable game pieces identifying a recyclable item and having a corresponding game money or token value, whereby when a player position marker lands on an action space in the playing path, the player is able to obtain the recyclable game piece indicated on the said action space.

2. The board game according to claim 1, further comprising at least one container from which the recyclable game pieces are stored and distributed therefrom to the players.

3. The board game according to claim 1, further comprising a plurality of receptacles to hold the recyclable game pieces, each player being assigned one of each of the receptacles to store the recyclable game pieces each player has acquired.

4. The board game according to claim 1, wherein the playing path is a clockwise oriented triangular playing path.

5. The board game of claim 1, wherein game money is provided in denominations of $5, $10, $20, $50, and $100.

6. The board game of claim 1, wherein the random number generation means is a six-sided specialized die, each side of the specialized die having one of 1,2,3 or 4 dots or a colour coded recycling symbol.

7. The board game of claim 1, wherein said game board further includes a first location for holding the plurality of reward cards and a second location for holding the plurality of penalty cards.

8. The board game of claim 1, wherein the plurality of scented game pieces are stored in a recycling depot game piece, the recycling depot game piece having a removable roof to allow access to the plurality of scented game pieces contained therein.

9. The board game of claim 8, wherein said game board further includes another location for holding the recycling depot game piece.

10. The board game of claim 1, wherein each of the plurality of scented game pieces possesses a different and unique scent.

11. The board game of claim 10, wherein each of the plurality of scented game pieces include a top portion having a first flip up portion and a second flip up portion, wherein the first flip up portion can be lifted so that the player can attempt to ascertain the scent contained in the scented game piece, and whereby the second flip up portion can be lifted to reveal the name of the scent contained in the scented game piece.

12. The board game of claim 1, wherein said game board further includes a location for holding the at least one container.

13. The board game of claim 1, wherein the reward and penalty cards are contained in card containers.

14. The board game of claim 1, wherein the playing path consists of 40 consecutive playing spaces.

15. The board game of claim 1, further comprising a price card for listing thereon the game money or token value of each of the recyclable game pieces.

16. A method of playing a board game comprising the steps of:

providing a game board having a playing path divided into a plurality of playing spaces therealong, the playing path beginning with a start space and terminating with an end space; each of said playing spaces requiring a player to accept a reward, a penalty, or perform an action, said game board further including a first location for holding reward cards and a second location for holding penalty cards;

providing a plurality of individual player position markers;

providing a specialized die for determining successive movements of each of said plurality of individual player position markers to a particular space in the playing path on said game board;

providing a quantity of game money or other reward token for distribution of a part thereof to the players during play of said board game;

providing a plurality of reward cards, whereby when a side of the specialized die lands head side up, the player will select a reward card and follow instruction thereon;

providing a plurality of penalty cards, whereby when another side of the specialized die lands head side up, the player will select a penalty card and follow instruction thereon;

providing a plurality of scented game pieces, whereby when one of said player position markers lands on a particular action space in the playing path on the game board, the player is required to attempt to identify a scent within one of the scented game pieces, whereby, if the player is correct in identifying the scent, a quantity of game money or reward tokens are distributed to the player;

providing a plurality of miniature recyclable game pieces, each of the recyclable game pieces identifying a recyclable item and having a corresponding game money or token value, whereby when a player position marker lands on an action space in the playing path, the player is able to obtain the recyclable game piece indicated on the said action space;

positioning the plurality of individual player position markers onto the start space for each player to play;

each player sequentially tossing the specialized die onto a surface of the game board;

each player moving a respective individual player position marker along the playing path a number of playing spaces away from the start space that corresponds to the number of the specialized die that lands head side up;

each player circumnavigating the game board, by alternating movement of respective individual player position markers along the playing path, through to said end space;

awarding bonus game money or reward tokens to the player moving a respective individual player position marker into said end space first, whereby the game ends; and declaring as winner the player with the highest accumulated total of game money value or reward tokens.

17. The method of playing a board game according to claim 16, including the step of:

(a) providing at least one container from which the recyclable game pieces are stored and distributed therefrom to the players; and (b) providing a plurality of receptacles to hold the recyclable game pieces, each player being assigned one of each of the receptacles to store the recyclable game pieces the player has acquired.

18. The method of playing a board game according to claim 16, wherein the step of declaring as winner, in the event of a tie, further comprises each of the players alternatingly being required to identify a scent contained within one of the scented game pieces, whereby, a first player who is incorrect in identifying the scent loses the game to the other player.

19. The method of playing a board game according to claim 16, wherein the step of declaring as winner, in the event of a tie, further comprises declaring as winner the player moving the respective individual player position marker into said end space first.

20. The method of playing a board game according to claim 16, including the step of providing a recycling depot game piece for storing the plurality of scented game pieces contained therein.

21. The method of playing a board game according to claim 16, wherein the step of providing a plurality of scented game pieces further comprises providing each of the scented game pieces with a different and unique scent.

* * * * *